US008318845B2

(12) United States Patent
Matsuda et al.

(10) Patent No.: US 8,318,845 B2
(45) Date of Patent: Nov. 27, 2012

(54) GOLF BALL

(75) Inventors: Satoshi Matsuda, Chichibu (JP); Hiroyuki Nagasawa, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 162 days.

(21) Appl. No.: 12/574,930

(22) Filed: Oct. 7, 2009

(65) Prior Publication Data

US 2011/0081991 A1 Apr. 7, 2011

(51) Int. Cl.
*A63B 37/12* (2006.01)
*A63B 37/00* (2006.01)
*C08L 75/06* (2006.01)

(52) U.S. Cl. ... 524/449; 524/451; 524/494; 525/440.01; 525/440.12; 525/457; 473/373; 473/378

(58) Field of Classification Search ..... None
See application file for complete search history.

(56) References Cited

U.S. PATENT DOCUMENTS

| | | | | |
|---|---|---|---|---|
| 6,416,425 | B1 * | 7/2002 | Maruko et al. | 473/376 |
| 6,632,147 | B2 * | 10/2003 | Cavallaro et al. | 473/374 |
| 6,806,323 | B2 * | 10/2004 | Ichikawa et al. | 525/440.12 |
| 7,358,320 | B2 | 4/2008 | Rajagopalan et al. | |
| 2002/0052254 | A1 * | 5/2002 | Ichikawa et al. | 473/378 |
| 2002/0160863 | A1 * | 10/2002 | Wu et al. | 473/378 |
| 2003/0125135 | A1 * | 7/2003 | Iwami et al. | 473/371 |
| 2003/0130065 | A1 * | 7/2003 | Watanabe | 473/371 |
| 2003/0236382 | A1 * | 12/2003 | Wu | 528/76 |
| 2005/0059756 | A1 * | 3/2005 | Kim et al. | 523/220 |
| 2005/0215355 | A1 * | 9/2005 | Nagasaki et al. | 473/371 |
| 2006/0166760 | A1 * | 7/2006 | Higuchi et al. | 473/371 |
| 2008/0051223 | A1 * | 2/2008 | Nagasawa et al. | 473/378 |

FOREIGN PATENT DOCUMENTS

JP 63132950 * 6/1988

OTHER PUBLICATIONS

Kwak, Preparation and Properties of Waterbourne Polyurethanes for Water-Vapor-Permeable Coating Materials; Journal of Applied Polymer Science vol. 89 (2003) pp. 123-129.*

* cited by examiner

*Primary Examiner* — David Buttner
(74) *Attorney, Agent, or Firm* — Sughrue Mion, PLLC

(57) ABSTRACT

The invention provides a golf ball having a core and a cover of at least one layer that is formed over the core and is made of a resin composition. The ball has a weight change ratio, in a 72-hour accelerated moisture absorption test conducted at a temperature of 40° C. and a relative humidity of 90%, of less than 0.287%. By using in the golf ball a polyurethane having a good resistance to water vapor transmission, the weight change ratio and decrease in initial velocity with use over an extended period of time are held to a minimum, enabling the ball quality to be maintained.

12 Claims, No Drawings

GOLF BALL

BACKGROUND OF THE INVENTION

The present invention relates to a golf ball having a core and one or more cover layer molded over the core. More specifically, the invention relates to a golf ball which undergoes little change in ball weight and little change in initial velocity due to the absorption of moisture and the like.

It is known that, when used for a long period of time, a golf ball absorbs moisture, etc., and that such absorption has a large influence on the quality of the ball, including the initial velocity. For example, a change in weight and a decrease in initial velocity due to absorption are observed in golf balls that use conventional polyurethane covers; such changes have a large effect on the distance traveled by the ball.

U.S. Pat. No. 7,358,320 describes a golf ball that employs in the cover material a polyurea the water vapor transmission of which has been ameliorated by using a fluorine-containing amine. In this golf ball, the water vapor transmission is ameliorated by including fluorine. However, owing to the influence of fluorine, adhesion of the cover to the intermediate layer or core worsens, which may lead to a decline in durability.

SUMMARY OF THE INVENTION

It is therefore an object of the present invention to provide a golf ball which, owing to the use of a polyurethane having an improved resistance to water vapor transmission, ameliorates both the weight change ratio and the decrease in initial velocity.

The inventors have conducted extensive investigations in order to achieve the above object. As a result, they have found that, in golf balls composed of a core encased by one or more cover layer, those golf balls which have a ball weight change ratio of less than 0.287% in a 72-hour accelerated moisture absorption test conducted at a temperature of 40° C. and a relative humidity of 90% hold the decrease in initial velocity to a minimum, enabling the quality of the ball—including the ball durability—to be maintained, and are thus capable of resolving the above problems. This discovery ultimately led to the present invention. In particular, when a resin composition containing a polyurethane or polyurea is used in at least one of the cover layers, employing a polyester polyol rather than a polyether polyol holds to a minimum the weight change ratio and the decrease in initial velocity of the ball, enabling the objects of the invention to be effectively achieved.

Accordingly, the invention provides the following golf balls.

[1] A golf ball comprising a core and a cover of at least one layer formed over the core, wherein the ball has a ball weight change ratio, in a 72-hour accelerated moisture absorption test conducted at a temperature of 40° C. and a relative humidity of 90%, of less than 0.287%.

[2] The golf ball of [1], wherein at least one layer of the cover is formed of a resin composition containing polyurethane or polyurea.

[3] The golf ball of [2], wherein the polyurethane or polyurea comprising the cover layer includes as soft segments therein an ester polyol or an ester-based amine-terminated component.

[4] The golf ball of [3], wherein the polyurethane or polyurea comprising the cover layer includes at least one selected from the group consisting of lactone polyols, adipate polyols, lactone-based amine-terminated compounds and adipate-based amine-terminated compounds.

[5] The golf ball of [4], wherein the polyurethane comprising the cover layer includes a lactone polyol.

[6] The golf ball of [1], wherein the cover layer includes an inorganic filler.

[7] The golf ball of [6], wherein the inorganic filler is a lamellar filler.

[8] The golf ball of [7], wherein the cover layer has a lamellar filler content of from 0 to 50 wt %.

[9] The golf ball of [7], wherein the cover layer has a lamellar filler content of from 5 to 40 wt %.

[10] The golf ball of [7], wherein the cover layer has a lamellar filler content of from 10 to 30 wt %.

[11] The golf ball of [2], wherein the polyurethane or polyurea comprising the cover layer is a thermoset, thermoplastic or reactive injection molding polyurethane or polyurea.

[12] The golf ball of [2], wherein the polyurethane comprising the cover layer is a thermoplastic polyurethane.

[13] The golf ball of [12], wherein the resin composition comprising the cover layer is composed of a thermoplastic polyurethane and an isocyanate mixture obtained by dispersing an isocyanate compound having at least two isocyanate groups as functional groups per molecule in a thermoplastic resin that is substantially non-reactive with isocyanate.

[14] The golf ball of [12], wherein the resin composition comprising the cover layer is a single resin blend composed primarily of a thermoplastic polyurethane and a polyisocyanate compound, in at least some portion of which polyisocyanate compound all the isocyanate groups on the molecule remain in an unreacted state.

[15] The golf ball of [2], wherein the polyurethane or polyurea comprising the cover layer has a Shore D hardness of from 30 to 70 and a flexural modulus of from 30 to 400 MPa.

[16] The golf ball of [1] which is a two-piece solid golf ball comprising a core and a single cover layer molded over the core.

DETAILED DESCRIPTION OF THE INVENTION

The invention is described more fully below.

The golf ball of the present invention, which is not shown in a drawing, has a core of at least one layer and a cover of at least one layer which encases the core. The ball has a weight change ratio, in a 72-hour accelerated moisture absorption test conducted at a temperature of 40° C. and a relative humidity of 90%, which must be less than 0.287%, and is preferably less than 0.250%. The weight of the golf ball is generally from 44.8 to 45.8 g. If a large change in weight occurs, the initial velocity of the ball will decrease significantly. Therefore, to minimize weight changes due to the absorption of moisture and the like, it is desirable to use a cover material having a good resistance to water vapor transmission.

The above ball weight change ratio is carried out using a test chamber. The golf ball is held in the chamber for 72 hours at a temperature of 40° C. and a relative humidity of 90%, then stabilized for one hour, following which the weight change ratio is determined. Measurement of the weight change ratio is carried out on a finished golf ball. Therefore, in cases where the surface of the golf ball cover is to be painted, measurement is carried out on a golf ball that has been painted.

In the golf ball of the invention, the cover layer encasing the core may be formed of a known material, examples of which include thermoplastic resins such as ionomeric resins, and various types of thermoplastic elastomers. Illustrative examples of thermoplastic elastomers include polyester-based thermoplastic elastomers, polyamide-based thermoplastic elastomers, polyurethane-based thermoplastic elastomers, olefin-based thermoplastic elastomers and styrene-based thermoplastic elastomers.

In the present invention, it is especially preferable for at least one cover layer to be formed of a resin composition containing a polyurethane or polyurea. In this case, the proportion of the overall resin composition accounted for by the polyurethane or polyurea is at least 50 wt %, and preferably at least 80 wt %. The polyurethane or polyurea is more preferably a thermoset, thermoplastic or reaction injection molding polyurethane or polyurea. The polyurethane and polyurea used in the invention are described below.

Polyurethane

The structure of the polyurethane which may be used in the invention includes an isocyanate, a long-chain polyol and a chain extender. Here, the long-chain polyol is not subject to any particular limitation, and may be any that is used in the prior art relating to thermoplastic polyurethanes. Exemplary long-chain polyols include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly or as combinations of two or more thereof. Of the long-chain polyols mentioned here, the use of polyester polyols is preferred from the standpoint of effectively achieving the objects of the invention. This is based on the finding that using a polyester polyurethane results in a smaller ball weight change ratio and a smaller decrease in ball initial velocity than when a polyether polyurethane is used.

No particular limitation is imposed on the method of producing the above polyurethane. Production may be carried out by either a prepolymer process or a one-shot process in which the long-chain polyol, chain extender and isocyanate are used and a known urethane-forming reaction is effected. Of these, a process in which melt polymerization is carried out in a substantially solvent-free state is preferred. Production by continuous melt polymerization using a multiple screw extruder is especially preferred.

In cases where a polyurethane is used as the cover material, polyurethane material (I) or polyurethane material (II) shown below may be employed. These materials are described in detail below.

Polyurethane Material (I)

This material (I) is a cover-molding material (C) composed primarily of components A and B below:

(A) a thermoplastic polyurethane material, (B) an isocyanate mixture obtained by dispersing (b-1) an isocyanate compound having as functional groups at least two isocyanate groups per molecule in (b-2) a thermoplastic resin that is substantially non-reactive with isocyanate.

In cases where the cover is formed with the above-described cover-molding material (C), a golf ball having a better feel on impact, controllability, cut resistance, scuff resistance and durability to cracking on repeated impact can be obtained.

Next, above components A to C are described.

The thermoplastic polyurethane material (A) has a structure which includes soft segments made of a polymeric polyol (polymeric glycol), and hard segments made of a chain extender and a polyisocyanate. Here, the polymeric polyol used as a starting material is not subject to any particular limitation, and may be any that is used in the prior art relating to thermoplastic polyurethane materials, such as polyester polyols and polyether polyols. From the standpoint of holding to a minimum the weight change ratio and the decrease in initial velocity of the ball, polyester polyols are preferable to polyether polyols. Illustrative examples of polyester polyols include adipate polyols such as polyethylene adipate glycol, polypropylene adipate glycol, polybutadiene adipate glycol and polyhexamethylene adipate glycol, and lactone polyols such as polycaprolactone polyol. Illustrative examples of polyether polyols include poly(ethylene glycol), poly(propylene glycol) and poly(tetramethylene glycol).

The chain extender employed is preferably one which is used in the art relating to conventional thermoplastic polyurethane materials. For example, a low-molecular-weight compound with a molecular weight of up to 2000 and having on the molecule at least two active hydrogen atoms capable of reacting with isocyanate groups is preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these, the chain extender is preferably an aliphatic diol having from 2 to 12 carbons, and is most preferably 1,4-butylene glycol.

The polyisocyanate compound is not subject to any particular limitation; preferred use may be made of one that is used in the prior art relating to thermoplastic polyurethanes. Specific examples include one or more selected from the group consisting of 4,4'-diphenylmethane diisocyanate, 2,4- or 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. Depending on the type of isocyanate used, the crosslinking reaction during injection molding may be difficult to control. In the practice of the invention, to provide a balance between stability at the time of production and the properties that are manifested, it is most preferable to use 4,4'-diphenylmethane diisocyanate, which is an aromatic diisocyanate.

A commercial product may be suitably used as the thermoplastic polyurethane material composed of the above-described material. Illustrative examples include those manufactured by DIC Bayer Polymer, Ltd. under the trade name Pandex, and those manufactured by Dainichi Seika Colour & Chemicals Mfg. Co., Ltd. under the trade name Resamine.

The isocyanate mixture (B) is obtained by dispersing (b-1) an isocyanate compound having as functional groups at least two isocyanate groups per molecule in (b-2) a thermoplastic resin that is substantially non-reactive with isocyanate. Here, the isocyanate compound (b-1) is preferably an isocyanate compound used in the prior art relating to thermoplastic polyurethane materials. Illustrative, non-limiting, examples include aromatic diisocyanates such as 4,4'-diphenylmethane diisocyanate, 2,4-toluene diisocyanate and 2,6-toluene diisocyanate; and aliphatic diisocyanates such as hexamethylene diisocyanate. From the standpoint of reactivity and work safety, the use of 4,4'-diphenylmethane diisocyanate is most preferred.

The thermoplastic resin (b-2) is preferably a resin having a low water absorption and excellent compatibility with thermoplastic polyurethane materials. Illustrative examples of such resins include polystyrene resins, polyvinyl chloride resins, ABS resins, polycarbonate resins, and polyester elastomers (e.g., polyether-ester block copolymers, polyester-ester block copolymers). From the standpoint of rebound resilience and strength, the use of a polyester elastomer, particularly a polyether-ester block copolymer, is especially preferred.

In the isocyanate mixture (B), it is desirable for the relative proportions of the thermoplastic resin (b-2) and the isocyanate compound (b-1), expressed as the weight ratio (b-2):(b-1), to be within a range of from 100:5 to 100:100, and especially from 100:10 to 100:40. If the amount of the isocyanate compound (b-1) relative to the thermoplastic resin (b-2) is too small, a greater amount of the isocyanate mixture (B) will have to be added to achieve an amount of addition sufficient for the crosslinking reaction with the thermoplastic polyurethane material (A). As a result, the thermoplastic resin (b-2) will exert a large influence, rendering inadequate the physical properties of the cover-molding material (C). On the other hand, if the amount of the isocyanate compound (b-1) relative to the thermoplastic resin (b-2) is too large, the isocyanate compound (b-1) may cause slippage to occur during mixing, making preparation of the isocyanate mixture (B) difficult.

The isocyanate mixture (B) can be obtained by, for example, adding the isocyanate compound (b-1) to the thermoplastic resin (b-2) and thoroughly working together these components at a temperature of from 130 to 250° C. using mixing rolls or a Banbury mixer, then either pelletizing or cooling and subsequently grinding. A commercial product such as Crossnate EM30 (available from Dainichi Seika Colour & Chemicals Mfg. Co., Ltd.) may be suitably used as the isocyanate mixture (B).

The cover-molding material (C) is composed primarily of the above-described thermoplastic polyurethane material (A) and isocyanate mixture (B). In the cover-molding material (C), the isocyanate mixture (B) is included in an amount, per 100 parts by weight of the thermoplastic polyurethane material (A), of at least 1 part by weight, preferably at least 5 parts by weight, and more preferably at least 10 parts by weight, but not more than 100 parts by weight, preferably not more than 50 parts by weight, and more preferably not more than 30 parts by weight. If too little isocyanate mixture (B) is included relative to the thermoplastic polyurethane material (A), a sufficient crosslinking effect will not be achieved. On the other hand, if too much is included, unreacted isocyanate may discolor the molded material.

In addition to the above-described ingredients, other ingredients may be included in the cover-molding material (C). For example, thermoplastic polymeric materials other than thermoplastic polyurethane materials may be included; illustrative examples include polyester elastomers, polyamide elastomers, ionomeric resins, styrene block elastomers, polyethylenes and nylon resins. In such a case, thermoplastic polymeric materials other than thermoplastic polyurethane materials may be included in an amount, per 100 parts by weight of the thermoplastic polyurethane material serving as the essential ingredient, of preferably at least 10 parts by weight, but not more than 100 parts by weight, preferably not more than 75 parts by weight, and more preferably not more than 50 parts by weight. The amount is selected as appropriate for such purposes as adjusting the hardness, improving the resilience, improving the flow properties, and improving the adhesion of the cover material. If necessary, various additives such as pigments, dispersants, antioxidants, light stabilizers, ultraviolet absorbers and parting agents may also be suitably included in the cover-molding material (C).

Molding of the cover from the cover-molding material (C) may be carried out by adding the isocyanate mixture (B) to the thermoplastic polyurethane material (A) and dry mixing, then using this mixture to mold a cover around the core with an injection molding machine. The molding temperature will vary according to the type of thermoplastic polyurethane material (A), although molding is carried out within a temperature range of generally from 150 to 250° C.

Reactions and crosslinking which take place in the golf ball cover obtained as described above are believed to involve the reaction of isocyanate groups with hydroxyl groups remaining in the thermoplastic polyurethane material to form urethane bonds, or the creation of an allophanate or biuret crosslinked form via a reaction involving the addition of isocyanate groups to urethane groups in the thermoplastic polyurethane material. In this case, although the crosslinking reaction has not yet proceeded to a sufficient degree immediately after injection molding of the cover-molding material (C), the crosslinking reaction can be made to proceed further by carrying out an annealing step after molding, in this way conferring the golf ball cover with useful characteristics. "Annealing," as used herein, refers to heat aging the cover at a constant temperature for a fixed length of time, or aging the cover for a fixed period at room temperature.

Polyurethane Material (II)

This material (II) is formed of a molded resin blend in which the primary components are (D) a thermoplastic polyurethane and (E) a polyisocyanate compound. By forming a cover composed primarily of such a polyurethane material, an excellent feel on impact, controllability, cut resistance, scuff resistance and durability to cracking on repeated impact can be achieved without a loss of resilience.

The above cover, which is composed primarily of a thermoplastic polyurethane, is formed of a resin blend in which the primary components are (D) a thermoplastic polyurethane and (E) a polyisocyanate compound.

To fully and effectively achieve the objects of the invention, a necessary and sufficient amount of unreacted isocyanate groups should be present within the cover resin material. Specifically, it is recommended that the combined weight of above components (D) and (E) account for at least 60%, and preferably at least 70%, of the total weight of the cover. Above components (D) and (E) are described in detail below.

The above thermoplastic polyurethane (D) is described. The thermoplastic polyurethane structure includes soft segments made of a long-chain polyol, and hard segments made of a chain extender and a polyisocyanate compound. Here, the long-chain polyol used as a starting material is not subject to any particular limitation, and may be any that is used in the prior art relating to thermoplastic polyurethanes. Exemplary long-chain polyols include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly or as combinations of two or more thereof. Of the long-chain polyols mentioned here, the use of polyester polyols is preferred because they enable the ball weight change ratio and the decrease in initial velocity of the ball to each be held to a minimum.

Illustrative examples of polyester polyols that may be used include adipate polyols such as polyethylene adipate glycol, polypropylene adipate glycol, polybutadiene adipate glycol, polyhexamethylene adipate glycol, and lactone polyols such as polycaprolactone polyol.

Illustrative examples of polyether polyols include poly (ethylene glycol), poly(propylene glycol), poly(tetramethylene glycol) and poly(methyltetramethylene glycol) obtained by the ring-opening polymerization of cyclic ethers. The polyether polyol may be used singly or as a combination of two or more thereof.

It is preferable for these long-chain polyols to have a number-average molecular weight in a range of 1,500 to 5,000. By using a long-chain polyol having a number-average molecular weight within this range, golf balls made with a thermoplastic polyurethane composition having excellent properties such as resilience and manufacturability can be reliably obtained. The number-average molecular weight of the long-chain polyol is more preferably in a range of 1,700 to 4,000, and even more preferably in a range of 1,900 to 3,000.

As used herein, "number-average molecular weight of the long-chain polyol" refers to the number-average molecular weight calculated based on the hydroxyl number measured in accordance with JIS K-1557.

Any chain extender employed in the prior art relating to thermoplastic polyurethane materials may be suitably used as the chain extender. For example, low-molecular-weight compounds with a molecular weight of 2000 or less which have on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of the above, the chain extender is preferably an aliphatic diol having from 2 to 12 carbons, and most preferably 1,4-butylene glycol.

Any polyisocyanate compound employed in the prior art relating to thermoplastic polyurethane materials may be suitably used without particular limitation as the polyisocyanate compound. For example, use may be made of one or more selected from the group consisting of 4,4'-diphenylmethane diisocyanate, 2,4- or 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. However, depending on the type of isocyanate, the crosslinking reaction during injection molding may be difficult to control. In the practice of the invention, to provide a balance between stability at the time of production and the properties that are manifested, it is most preferable to use 4,4'-diphenylmethane diisocyanate, which is an aromatic diisocyanate.

It is most preferable for the thermoplastic polyurethane serving as component D to be a thermoplastic polyurethane synthesized using a polyester polyol as the long-chain polyol, using an aliphatic diol as the chain extender, and using an aromatic diisocyanate as the polyisocyanate compound. It is desirable, though not essential, for the chain extender to be 1,4-butylene glycol, and for the aromatic diisocyanate to be 4,4'-diphenylmethane diisocyanate.

The mixing ratio of active hydrogen atoms to isocyanate groups in the above polyurethane-forming reaction may be adjusted within a preferred range so as to make it possible to obtain a golf ball which is composed of a thermoplastic polyurethane composition and has various improved properties, such as rebound, spin performance, scuff resistance and manufacturability. Specifically, in preparing a thermoplastic polyurethane by reacting the above long-chain polyol, polyisocyanate compound and chain extender, it is desirable to use the respective components in proportions such that the amount of isocyanate groups on the polyisocyanate compound per mole of active hydrogen atoms on the long-chain polyol and the chain extender is from 0.95 to 1.05 moles.

No particular limitation is imposed on the method of preparing the above thermoplastic polyurethane (D). Production may be carried out by either a prepolymer process or a one-shot process in which the long-chain polyol, chain extender and polyisocyanate compound are used and a known urethane-forming reaction is effected. Of these, a process in which melt polymerization is carried out in a substantially solvent-free state is preferred. Production by continuous melt polymerization using a multiple screw extruder is especially preferred.

The thermoplastic polyurethane (D) used in the invention may be a commercial product, such as Pandex (manufactured by DIC Bayer Polymer, Ltd.).

Next, concerning the polyisocyanate compound used as above component E, it is essential that, in at least some portion thereof within a single resin blend, all the isocyanate groups on the molecule remain in an unreacted state. That is, polyisocyanate compound in which all the isocyanate groups on the molecule are in a completely free state should be present within a single resin blend, and such a polyisocyanate compound may be present together with a polyisocyanate compound in which a portion of the isocyanate groups on the molecule are in a free state.

Various isocyanates may be used without particular limitation as the polyisocyanate compound. Specific examples include one or more selected from the group consisting of 4,4'-diphenylmethane diisocyanate, 2,4- or 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. Of the above group of isocyanates, using 4,4'-diphenylmethane diisocyanate, dicyclohexylmethane diisocyanate and isophorone diisocyanate is preferred for achieving a good balance between the influence on moldability by, for example, the rise in viscosity associated with reaction with the thermoplastic polyurethane serving as component D, and the properties of the resulting golf ball cover material.

A thermoplastic elastomer other than the above-described thermoplastic polyurethane may be included as component F together with above components D and E. Including this component F in the above resin blend enables the flow properties of the resin blend to be further improved and enables various properties required of the golf ball cover material, such as resilience and scuff resistance, to be enhanced.

Component F, which is a thermoplastic elastomer other than the above thermoplastic polyurethane, is exemplified by one or more thermoplastic elastomer selected from among polyester elastomers, polyamide elastomers, ionomeric resins, styrene block elastomers, hydrogenated styrene-butadiene rubbers, styrene-ethylene/butylene-ethylene block copolymers and modified forms thereof, ethylene-ethylene/butylene-ethylene block copolymers and modified forms thereof, styrene-ethylene/butylene-styrene block copolymers and modified forms thereof, ABS resins, polyacetals, polyethylenes and nylon resins. The use of polyester elastomers, polyamide elastomers and polyacetals is especially preferred because the resilience and scuff resistance are enhanced, owing to reactions with isocyanate groups, while at the same time a good manufacturability is retained.

The relative proportions of above components D, E and F are not subject to any particular limitation. However, to fully achieve the objects of the invention, it is preferable for the weight ratio D:E:F of the respective components to be from 100:2:50 to 100:50:0, and more preferably from 100:2:50 to 100:30:8.

The resin blend is prepared by mixing together component D, component E, and also component F. It is critical to select the mixing conditions such that, in at least some portion of the polyisocyanate compound present, all the isocyanate groups on the molecule remain in an unreacted state. For example, it is necessary to furnish treatment such as mixture in an inert gas (e.g., nitrogen) or in a vacuum state. The resin blend is then injection-molded around a core which has been placed in a mold. To smoothly and easily handle the resin blend, it is preferable for the blend to be formed into pellets having a length of 1 to 10 mm and a diameter of 0.5 to 5 mm. Isocyanate groups in an unreacted state remain in these resin pellets; the unreacted isocyanate groups react with component D or component F to form a crosslinked material while the resin blend is being injection-molded about the core and due to post-treatment such as annealing thereafter.

In addition to the above thermoplastic polyurethane ingredients, various optional additives may also be included in the above resin blend. For example, pigments, dispersants, antioxidants, light stabilizers, ultraviolet absorbers, and parting agents may be suitably included.

The melt mass flow rate (MFR) of the resin blend at 210° C. is not subject to any particular limitation. However, to increase the flow properties and manufacturability, the MFR is preferably at least 5 g/10 min, and more preferably at least 6 g/10 min. If the melt mass flow rate of the resin blend is too low, the flow properties decrease, which may cause eccentricity during injection molding and may also lower the degree of freedom in the thickness of the cover that can be molded. The measured value of the melt mass flow rate is obtained in accordance with JIS-K7210 (1999 edition).

The method of molding the cover using the above material may involve feeding the above resin blend to an injection-molding machine and injecting the molten resin blend around the core. Although the molding temperature in this case will vary depending on the type of thermoplastic polyurethane, the molding temperature is generally from 150 to 250° C.

When injection molding is carried out, it is desirable though not essential to carry out molding in a low-humidity environment such as by purging with an inert gas (e.g., nitrogen) or a low-moisture gas (e.g., low dew-point dry air), or by vacuum treating, some or all places on the resin paths from the resin feed area to the mold interior. Illustrative, non-limiting, examples of the medium used for transporting the resin include low-moisture gases such as low dew-point dry air or nitrogen. By carrying out molding in such a low-humidity environment, reaction by the isocyanate groups is kept from proceeding before the resin has been charged into the mold interior. As a result, polyisocyanate in which the isocyanate groups are present in an unreacted state is included to some degree in the resin molded part, thus making it possible to reduce variable factors such as an unwanted rise in viscosity and enabling the real crosslinking efficiency to be enhanced.

Techniques that may be used to confirm the presence of polyisocyanate compound in an unreacted state within the resin blend prior to injection molding about the core include those which involve extraction with a suitable solvent that selectively dissolves out only the polyisocyanate compound. However, an example of a simple and convenient method is one in which confirmation is carried out by simultaneous thermogravimetric and differential thermal analysis (TG-DTA) measurement in an inert atmosphere. For example, when the resin blend (cover material) used in the invention is heated in a nitrogen atmosphere at a temperature ramp-up rate of 10° C./min, a gradual drop in the weight, of diphenylmethane diisocyanate can be observed from about 150° C. On the other hand, in a resin sample in which the reaction between the thermoplastic polyurethane material and the isocyanate mixture has been carried out to completion, a weight drop from about 150° C. is not observed, but a weight drop from about 230 to 240° C. can be observed.

After the resin blend has been molded as described above, its properties as a golf ball cover can be further improved by carrying out annealing so as to induce the crosslinking reaction to proceed further. "Annealing," as used herein, refers to aging the cover in a fixed environment for a fixed length of time.

Polyurea

Alternatively, a polyurea composed mainly of urea linkages formed by reacting an isocyanate with an amine-terminated compound may be used. The polyurea is a composition which includes (i) an isocyanate, (ii) a long-chain polyol and/or a long-chain polyamine, and (iii) a polyol- and/or amine-type curing agent.

In order to hold to a minimum the weight change ratio and the initial velocity decrease of the finished ball, it is preferable to use an ester polyol as the polyol. Examples of such polyols that may be used include adipate-based polyols such as polyethylene adipate glycol, polypropylene adipate glycol, polybutadiene adipate glycol and polyhexamethylene adipate glycol; and lactone-based polyols such as polycaprolactone polyol.

The isocyanate is the same as that described in connection with the above polyurethane.

Amine-Terminated Compound

The amine-terminated compound, while not subject to any particular limitation, may be a polycaprolactone obtained by polymerizing ε-caprolactone using a diamine or glycol as the initiator. Illustrative examples of diamines include bis(2-aminoethyl)ether, 2-(2-aminoethylamino)ethanol, polyoxyethylene diamine, propylenediamine, polyoxypropylenediamine, 1,4-butanediamine, triamines composed primarily of trimethyloipropane, neopentyl diamine, hexanediamine polytetramethylene ether diamine, and mixtures thereof.

Aside from the above ingredients, various types of additives, such as pigments, dispersants, antioxidants, light stabilizers, ultraviolet absorbers and parting agents, may also be used in the polyurethane or polyurea-containing resin composition.

The number-average molecular weight of the above polyol or amine-terminated compound is preferably from 1000 to 5000, more preferably from 1500 to 4000, and even more preferably from 1900 to 3000. Within this range in the average molecular weight, properties such as the resilience and manufacturability are even better.

No particular limitation is imposed on the method of producing the above polyurea. Production may be carried out by either a prepolymer process or a one-shot process in which a long-chain polyamine, a chain extender and an isocyanate are used.

The properties of the polyurethane or polyurea making up the above cover layer are not subject to any particular limitation, although it is desirable to use a polyurethane or polyurea having a Shore D hardness in a range of from 30 to 70 and a flexural modulus in a range of from 30 to 400 MPa.

The cover layer has a hardness, expressed as the Shore D hardness, of preferably from 30 to 70, and more preferably from 45 to 65. The Shore D hardness of the cover layer refers to the Shore D hardness of a resin sheet prepared by injection molding, and is a value measured in accordance with ASTM D2240.

At least one cover layer in the present invention may contain an inorganic filler. In particular, a lamellar filler such as mica, talc or glass may be included. In this case, the lamellar filler used has a thickness in a range of from 1 to 10 μm and a particle size in a range of from 5 to 1000 μm. It is preferable that the thickness of the lamellar filler not exceed the particle size. Also, the lamellar filler is included in an amount, based on the total weight of the cover layer, which is in a range of preferably from 0 to 50 wt %, more preferably from 10 to 40 wt %, and even more preferably from 15 to 30 wt %. If this amount is low, the water vapor barrier effect by the cover layer will decrease; on the other hand, if the amount is too high, the scuff resistance of the ball may worsen.

The method of molding the cover layer of the inventive golf ball may involve, for example, feeding the above cover material to an injection-molding machine and injecting the molten cover material around the core. Although the molding temperature in this case will vary depending on the type of thermoplastic polyurethane, the molding temperature is in a range of generally from 150 to 250° C.

No particular limitation is imposed on the core used in the inventive golf ball. Use may be made of various types of cores, such as solid cores for two-piece balls, solid cores having a plurality of vulcanized rubber layers, solid cores having a plurality of resin layers, and thread-wound cores having a rubber thread layer. The diameter, weight, hardness, material and other properties of the core are also not subject to any particular limitations.

The core may be formed using a known rubber material as the base. A known base rubber such as a natural rubber or a synthetic rubber may be used as the base rubber. More specifically, the use of primarily polybutadiene, particularly cis-1,4-polybutadiene having a cis structure of at least 40%, is recommended. Also, if desired, a natural rubber, polyisoprene rubber or styrene-butadiene rubber, for example, may be used together with the above-described polybutadiene in the base rubber. The polybutadiene may be synthesized with a rare-earth catalyst such as a neodymium catalyst, or with a metal catalyst such as a cobalt catalyst or a nickel catalyst.

The above base rubber may include, for example, co-crosslinking agents such as unsaturated carboxylic acids and metal salts thereof; inorganic fillers such as zinc oxide, barium sulfate and calcium carbonate; and organic peroxides such as dicumyl peroxide and 1,1-bis(t-butylperoxy)cyclohexane. If necessary, other additives such as commercial antioxidants may also be suitably added.

In the golf ball of the invention, when the ball has a structure which includes an intermediate layer between the core and the cover layer, the hardness, material, thickness and other characteristics of this intermediate layer are not subject to any particular limitation. In cases where an ionomer is used as the intermediate layer material, the resistance to water vapor transmission may be greatly improved.

In the golf ball of the invention, dimples may be molded on the surface of the cover according to a conventional method, and finishing treatment such as buffing, stamping and painting may be carried out on the surface after molding.

Any of various coatings may be applied to the surface of the golf ball cover. Given the need to withstand the harsh conditions of golf ball use, preferred examples of coatings that may be used include two-part curing urethane paints, particularly non-yellowing urethane paints.

The golf ball of the invention, which can be manufactured so as to conform with the Rules of Golf for competitive play, may be produced to a ball diameter which is not less than 42.67 mm and to a weight which is not more than 45.93 g. The upper limit in the ball diameter is preferably not more than 44.0 mm, more preferably not more than 43.5 mm, and most preferably not more than 43.0 mm. The lower limit in the weight is preferably not less than 44.5 g, more preferably not less than 45.0 g, even more preferably not less than 45.1 g, and most preferably not less than 45.2 g.

As described above, in the golf ball of the invention, by using a polyurethane having an improved resistance to water vapor transmission, the weight change ratio and decrease in initial velocity due to the absorption of moisture and the like are held to a minimum, enabling the ball quality to be maintained.

EXAMPLES

The following Examples and Comparative Examples are provided by way of illustration and not by way of limitation.

Examples 1 to 4, Comparative Examples 1 to 3

Core materials of the compositions shown in Table 1 below were masticated, then molded and vulcanized at 155° C. for 20 minutes, thereby giving solid cores having a diameter of 39.3 mm for use in two-piece solid golf balls.

TABLE 1

| | Example | | | | Comparative Example | | |
|---|---|---|---|---|---|---|---|
| (parts by weight) | 1 | 2 | 3 | 4 | 1 | 2 | 3 |
| cis-1, 4-Polybutadiene | 100 | 100 | 100 | 100 | 100 | 100 | 100 |
| Zinc acrylate | 30 | 30 | 30 | 30 | 30 | 30 | 30 |
| Zinc oxide | 5 | 5 | 5 | 5 | 5 | 5 | 5 |
| Barium sulfate | 18.6 | 18.6 | 18.6 | 18.6 | 18.6 | 18.6 | 18.6 |
| Antioxidant | 0.1 | 0.1 | 0.1 | 0.1 | 0.1 | 0.1 | 0.1 |
| Zinc stearate | 5 | 5 | 5 | 5 | 5 | 5 | 5 |
| Zinc salt of pentachloro-thiophenol | 0.2 | 0.2 | 0.2 | 0.2 | 0.2 | 0.2 | 0.2 |
| Peroxide | 1.2 | 1.2 | 1.2 | 1.2 | 1.2 | 1.2 | 1.2 |

The core formulations in Table 1 were as follows.

cis-1,4-Polybutadiene: Available under the trade name "BR 730" from JSR Corporation.

Zinc acrylate: Available from Nihon Jyoryu Kogyo Co., Ltd.

Zinc oxide: Available under the trade name "Zinc Oxide Grade 3" from Sakai Chemical Industry Co., Ltd.

Barium sulfate: Available under the trade name "Precipitated Barium Sulfate 100" from Sakai Chemical Industry Co., Ltd.

Antioxidant: Available under the trade name "Nocrac NS-6" from Ouchi Shinko Chemical Industry Co., Ltd.

Zinc stearate: Available under the trade name "Zinc Stearate G" from NOF Corporation.

Zinc salt of pentachlorothiophenol: Zhejiang Cho & Fu Chemical Co., Ltd. (China)

Peroxide: Available under the trade name "Perhexa C-40" from NOF Corporation.

Cover Manufacturing Process

Next, in Examples 1 and 2 and Comparative Example 1, the solid core was placed inside an injection mold, pellets of the thermoplastic polyurethane shown in Table 2 were dry blended with pellets of the isocyanate mixture shown in Table 2, and the resulting blend was injection-molded around the core, thereby giving two-piece golf balls having a cover with a thickness of 1.7 mm.

In Examples 3 and 4 and Comparative Examples 2 and 3, the respective starting materials (unit: parts by weight) shown in Table 2 were mixed under a nitrogen gas atmosphere in a twin-screw extruder to form a cover resin blend. This resin blend was in the form of pellets having a length of 3 mm and a diameter of 1 to 2 mm. The above solid core was placed within an injection mold, and the cover material was injection-molded around the core, thereby giving a two-piece golf ball having a cover with a thickness of 1.7 mm.

TABLE 2

| (parts by weight) | Example 1 | Example 2 | Example 3 | Example 4 | Comparative Example 1 | Comparative Example 2 | Comparative Example 3 |
|---|---|---|---|---|---|---|---|
| Pandex T8260 | | | | | 50 | | 50 |
| Pandex T8295 | | | | | 50 | 100 | 50 |
| Pandex T2198 | 100 | | 100 | 75 | | | |
| Pandex T5965D | | 100 | | 25 | | | |
| Polyisocyanate mixture | 18 | 18 | | | 18 | | |
| Polyisocyanate compound | | | 7.5 | 7.5 | | 7.5 | 7.5 |
| Thermoplastic elastomer | | | 11 | 11 | | 11 | 11 |
| Polyethylene wax | 1 | 1 | 1 | 1 | 1 | 1 | 1 |
| Titanium oxide | 3 | 3 | 3 | 3 | 3 | 3 | 3 |

Details on each of the ingredients in Table 2 are given below.

Pandex 8260 (Trade Name)

A MDI-PTMG type thermoplastic polyurethane material produced by DIC Bayer Polymer, Ltd. Resin hardness (Shore D), 60.

Pandex 8295 (Trade Name)

A MDI-PTMG type thermoplastic polyurethane material produced by DIC Bayer Polymer, Ltd. Resin hardness (Shore A), 95.

Pandex T2198 (Trade Name)

A MDI-ester (lactone) type thermoplastic polyurethane material produced by DIC Bayer Polymer, Ltd. Resin hardness (Shore A), 98.

Pandex T5965D (Trade Name)

A MDI-ester (lactone) type thermoplastic polyurethane material produced by DIC Bayer Polymer, Ltd. Resin hardness (Shore D), 65.

Polyisocyanate Mixture

Crossnate EM-30 (an isocyanate masterbatch produced by Dainichi Seika Colour & Chemicals Mfg. Co., Ltd., and containing 30% of 4,4'-diphenylmethane diisocyanate. The masterbatch base resin was a polyester elastomer.)

Polyisocyanate Compound 4,4'-Diphenylmethane diisocyanate

Thermoplastic Elastomer

Available under the trade name "Hytrel 4001" from DuPont-Toray Co., Ltd.

Polyethylene Wax

Available under the trade name "Sanwax 161P" from Sanyo Chemical Industries, Ltd.

Titanium Oxide

Available under the trade name "Tipaque R550" from Ishihara Sangyo Kaisha, Ltd.

The cover properties and the characteristics of the three-piece solid golf balls obtained were investigated as described below. The results are shown in Table 3.

Shore D Hardness of Cover Material

The Shore D hardness of a sheet produced by injection molding was measured in accordance with ASTM D2240. The resin sheet was injection-molded at a molding temperature of 220° C.

Flexural Modulus of Cover Layer

The flexural modulus of a 2 mm thick sheet produced by injection molding was measured in accordance with ASTM D790.

Deflection of Finished Ball

Using a model 4204 test system manufactured by Instron Corporation, the solid cores and the finished products were each compressed at a rate of 10 mm/min, and the difference between the deflection under a load of 10 kg and the deflection under a load of 130 kg was measured.

Scuff Resistance

Golf balls were held at a temperature of 23° C., 13° C. or 0° C. and the respective balls were hit at a head speed of 33 m/s using a pitching wedge mounted on a swing robot machine, following which damage from the impact was visually rated according to the following criteria.

5: No damage whatsoever or substantially free of apparent damage.
4: Slight damage is apparent, but of minimal concern.
3: Surface is somewhat frayed.
2: Surface is frayed and damaged dimples are apparent.
1: Some dimples are completely obliterated.

Weight Change Ratio of Ball

The ball was held for 72 hours at a temperature of 40° C. and 90% relative humidity in a test chamber (model PR-1ST, produced by Espec Corporation), then removed from the chamber. The weight one hour later was measured, and the difference with the weight prior to the test was shown in the table.

Change in Initial Velocity of Ball

The ball was held for 72 hours at a temperature of 40° C. and 90% humidity, then removed. The initial velocity one hour later was measured in accordance with the measurement method of the USGA (R&A), and the difference with the initial velocity prior to the test was shown in the table.

TABLE 3

| | | | Example 1 | Example 2 | Example 3 | Example 4 | Comparative Example 1 | Comparative Example 2 | Comparative Example 3 |
|---|---|---|---|---|---|---|---|---|---|
| Core diameter (mm) | | | 39.3 | 39.3 | 39.3 | 39.3 | 39.3 | 39.3 | 39.3 |
| Thickness of cover layer (mm) | | | 1.7 | 1.7 | 1.7 | 1.7 | 1.7 | 1.7 | 1.7 |
| Ball diameter (mm) | | | 42.7 | 42.7 | 42.7 | 42.7 | 42.7 | 42.7 | 42.7 |
| Ball weight (g) | | | 45.3 | 45.3 | 45.3 | 45.3 | 45.3 | 45.3 | 45.3 |
| Ball deflection (mm) | | | 2.8 | 2.8 | 2.8 | 2.8 | 2.8 | 2.8 | 2.8 |
| Ball | Scuff resistance | 23° C. | 3 | 3 | 4 | 4 | 3 | 4 | 4 |
| | | 13° C. | 4 | 4 | 5 | 5 | 3 | 4 | 4 |
| | | 0° C. | 4 | 4 | 5 | 5 | 3 | 4 | 4 |
| | Weight change (g) | | 0.11 | 0.09 | 0.09 | 0.09 | 0.15 | 0.13 | 0.13 |
| | Weight change ratio (%) | | 0.242 | 0.199 | 0.199 | 0.199 | 0.331 | 0.287 | 0.287 |
| | Decrease in initial velocity (m/s) | | −0.19 | −0.29 | −0.22 | −0.23 | −0.34 | −0.28 | −0.25 |

TABLE 3-continued

| | | Example | | | | Comparative Example | | |
|---|---|---|---|---|---|---|---|---|
| | | 1 | 2 | 3 | 4 | 1 | 2 | 3 |
| Cover | Sheet hardness (Shore D) | 57 | 67 | 60 | 65 | 56 | 55 | 59 |
| | Flexural modulus (MPa) | 108 | 258 | 219 | 329 | 268 | 262 | 338 |

As is apparent in the above table, the two-piece solid golf balls of Examples 1 to 4 according to the invention had a smaller weight change ratio and a smaller decrease in the ball initial velocity, and were thus of better quality, than the balls obtained in Comparative Examples 1 to 3.

The invention claimed is:

1. A golf ball comprising a core and a cover of at least one layer formed over the core, wherein the ball has a ball weight change ratio, in a 72-hour accelerated moisture absorption test conducted at a temperature of 40° C. and a relative humidity of 90%, of less than 0.287%, and wherein the cover layer includes the lamellar filler selected from the group consisting of mica, talc and glass, and the thickness of the lamellar filler is within a range of from 1 to 10 μm and the particle size of the lamellar filler is within a range of from 5 to 1000 μm, and wherein the outermost layer of the cover is formed of a resin composition selected from among [I], [II] and [III]

[I] a resin composition containing polyurethane which includes as soft segments an ester polyol, wherein the resin composition comprises a thermoplastic polyurethane and an isocyanate mixture obtained by dispersing an isocyanate compound having at least two isocyanate groups as functional groups per molecule in a thermoplastic resin that is substantially non-reactive with isocyanate;

[II] a resin composition containing polyurethane which includes as soft segments an ester polyol, wherein the resin composition comprises a resin blend that consisting of a plurality of the same kind of pellets which are composed primarily of a thermoplastic polyurethane and a polyisocyanate compound, in at least some portion of which polyisocyanate compound all the isocyanate groups on the molecule remain in an unreacted state; and

[III] a resin composition containing polyurea which includes as soft segments an ester-based amine-terminated component; and wherein two-part curing urethane paints are applied to the surface of the outermost layer of the cover.

2. The golf ball of claim 1, wherein the polyurethane or polyurea comprising the cover layer includes at least one selected from the group consisting of lactone polyols, adipate polyols, lactone-based amine-terminated compounds and adipate-based amine-terminated compounds.

3. The golf ball of claim 2, wherein the polyurethane comprising the cover layer includes a lactone polyol.

4. The golf ball of claim 1, wherein the cover layer has a lamellar filler up to 50 wt %.

5. The golf ball of claim 1, wherein the cover layer has a lamellar filler content of from 5 to 40 wt %.

6. The golf ball of claim 1, wherein the cover layer has a lamellar filler content of from 10 to 30 wt %.

7. The golf ball of claim 1, wherein the polyurethane or polyurea comprising the cover layer is a thermoset, thermoplastic or reactive injection molding polyurethane or polyurea.

8. The golf ball of claim 1, wherein the polyurethane or polyurea comprising the cover layer has a Shore D hardness of from 30 to 70 and a flexural modulus of from 30 to 400 MPa.

9. The golf ball of claim 1 which is a two-piece solid golf ball comprising a core and a single cover layer molded over the core.

10. The golf ball of claim 1, wherein the ball has a structure which includes an intermediate layer between the core and the cover layer, and an ionomer is used as the intermediate layer material, thereby to improve the resistance to water vapor transmission.

11. The golf ball of claim 1, wherein the cover layer has a hardness, expressed as the Shore D hardness, of from 57 to 67.

12. The golf ball of claim 1, wherein the cover layer has a flexural modulus of from 108 to 329 MPa.

* * * * *